US006842925B1

(12) United States Patent
Owens et al.

(10) Patent No.: US 6,842,925 B1
(45) Date of Patent: Jan. 18, 2005

(54) NURSING PILLOW

(76) Inventors: Marilou Owens, 141 Andrew Ave., East Meadow, NY (US) 11554; Jill Shaneman, 926 Maple St., Honey Brook, PA (US) 19344

( * ) Notice: Subject to any disclaimer, the term of this patent is extended or adjusted under 35 U.S.C. 154(b) by 0 days.

(21) Appl. No.: 10/787,011

(22) Filed: Feb. 25, 2004

Related U.S. Application Data

(63) Continuation-in-part of application No. 10/245,597, filed on Sep. 17, 2002, now Pat. No. 6,711,770.

(51) Int. Cl.[7] ..... A47D 13/08; A47G 9/00

(52) U.S. Cl. ..... 5/655; 5/922

(58) Field of Search ..... 5/655, 652, 657, 5/922

(56) References Cited

U.S. PATENT DOCUMENTS

| | | | | | |
|---|---|---|---|---|---|
| 4,736,474 | A | * | 4/1988 | Moran et al. | 5/627 |
| 5,029,351 | A | | 7/1991 | Weber | 5/655 |
| D318,969 | S | | 8/1991 | Byrn | D6/601 |
| 5,092,005 | A | | 3/1992 | Byrn | 5/636 |
| 5,109,557 | A | | 5/1992 | Koy et al. | 5/655 |
| 5,115,529 | A | * | 5/1992 | White | 5/655 |
| 5,154,649 | A | * | 10/1992 | Pender | 5/655 |
| 5,224,637 | A | * | 7/1993 | Colombo | 5/655 X |
| 5,519,906 | A | | 5/1996 | Fanto-Chan | 5/631 |
| 5,581,833 | A | | 12/1996 | Zenoff | 5/655 |
| 6,038,720 | A | | 3/2000 | Matthews et al. | 5/639 |
| 6,061,854 | A | | 5/2000 | Crowley | 5/655 |
| D444,981 | S | | 7/2001 | Hall et al. | D6/601 |
| 6,279,185 | B1 | | 8/2001 | Matthews | 5/655 |
| D450,517 | S | | 11/2001 | Darling et al. | D6/601 |
| 6,564,408 | B2 | * | 5/2003 | Van Vuuren | 5/655 |
| 6,711,770 | B1 | * | 3/2004 | Owens et al. | 5/655 |

* cited by examiner

*Primary Examiner*—Robert G. Santos
(74) *Attorney, Agent, or Firm*—Collard & Roe, P.C.

(57) ABSTRACT

A support pillow for supporting an infant during nursing, comprises a generally U-shaped base having two free ends, a top surface and a bottom surface, and two infant securing straps attached to the base. The straps are adapted to be wrapped over an infant resting on the top surface of the base and be removably connected to each other to secure the infant on the base.

6 Claims, 4 Drawing Sheets

NURSING PILLOW

CROSS-REFERENCE TO RELATED APPLICATIONS

This is a continuation-in-part of U.S. patent application Ser. No. 10/245,597 filed on Sep. 17, 2002 now U.S. Pat. No. 6,711,770.

BACKGROUND OF THE INVENTION

1. Field of the Invention

This invention relates to a nursing pillow having a strap to keep a baby from rolling off during nursing.

2. The Prior Art

While nursing an infant, the mother's arms and back can often become sore due to holding the infant in an awkward position for prolonged periods of time. There have been many different devices that have been developed to make nursing more comfortable for both the mother and infant.

One of the most common devices is a nursing pillow. This pillow is generally U- or C-shaped and fits around the mother's waist. The infant then lies across the pillow during nursing. The pillow supports the infant's weight, thus relieving stress on the mother's back and arms.

While these pillows have been helpful, the infant is not secured to the pillow and can roll off of the pillow if the mother inadvertently lets go of the infant during nursing. This can be especially risky during feedings in the middle of the night, when the mother may fall asleep during nursing.

Another drawback of the common nursing pillow is its large width. Many nursing pillows are so wide that it becomes impossible for the wearer to sit in a conventional armchair or rocker while wearing the pillow.

SUMMARY OF THE INVENTION

It is therefore an object of the invention to provide a nursing pillow that prevents the baby from rolling off during nursing.

It is another object of the invention to provide a nursing pillow that has a narrow profile to enable the wearer to sit in narrow chairs.

These and other objects of the invention are accomplished by a support pillow comprising a generally U-shaped base having two free ends, a top surface and a bottom surface, and an infant securing strap attached at one end to the bottom surface of the base. The strap is adapted to be wrapped over an infant resting on the top surface of the base. The free end of the strap is removably securable on the base to secure the infant on the base during nursing. In an alternative embodiment, the strap is a two-part strap, each part of the strap being secured at one end to the base. The other end of each part is securable to each other to keep the infant secured to the base. This is especially useful late at night when the mother and/or the infant may fall asleep during nursing.

The free end is preferably securable to the base or to the other part of the strap in the two-part variation via a hook-and loop type fastener such as Velcro®. Other types of fasteners, such as snaps, hooks, etc, could also be used. The hook and loop fastener preferably comprises a strip of fastener across the free end of the strap and two strips of fastener along the base or the other strap. The two strips are positioned perpendicular to the strip across the free end, so that the strap can be attached to the base or the other strap along a defined area to accommodate infants of different sizes.

The strap or straps are preferably made of a breathable mesh fabric so that the infant can breathe through it in the event that the infants head may slip under the strap. The base is preferably made of a fabric shell filled with a soft filler. However, other arrangements could be used as well, such as a solid foam base The two ends of the base are preferably attachable to each other via a buckle. Other attachment devices could also be used, such as tying the ends together, a button, a hook, etc.

The top surface of the base is slanted so that when the pillow is worn around the waist of the mother the infant is tilted so that its head faces the mother, placing it in an optimal position for nursing. The base has a larger cross section in a central area than at its two ends so that the ends are easily deformed to wrap around the waist of the mother. The central area is preferably wide and thick, to provide ample room for supporting the infant and to raise the infant to a sufficient height so as to enable nursing without elevation by the mother's arms.

The nursing pillow according to the invention provides a safe, comfortable environment for nursing an infant. It is simple to use and comfortable to wear.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
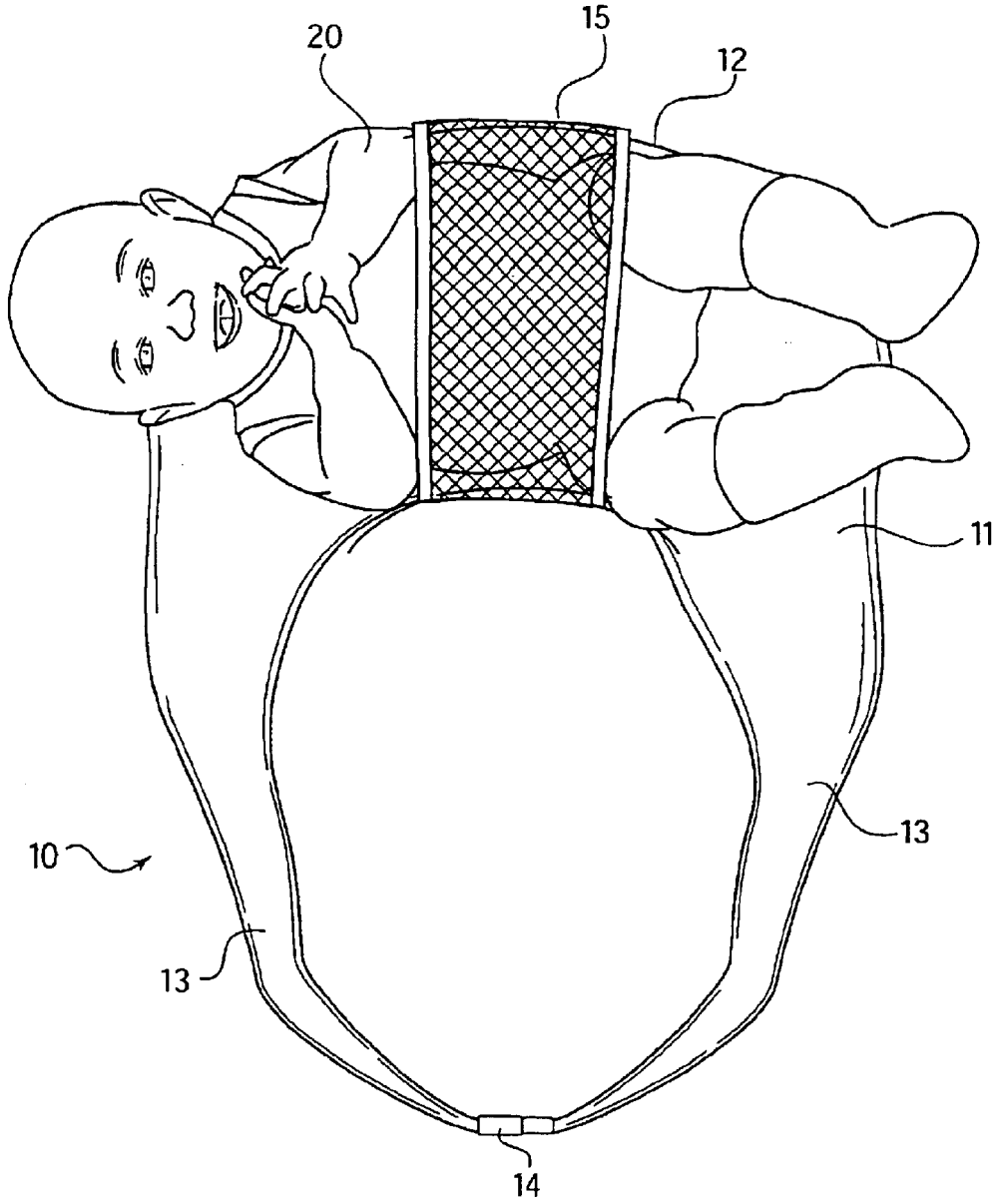
FIG. 1 shows a top view of the nursing pillow according to the invention with a baby resting thereon.
Figure 2:
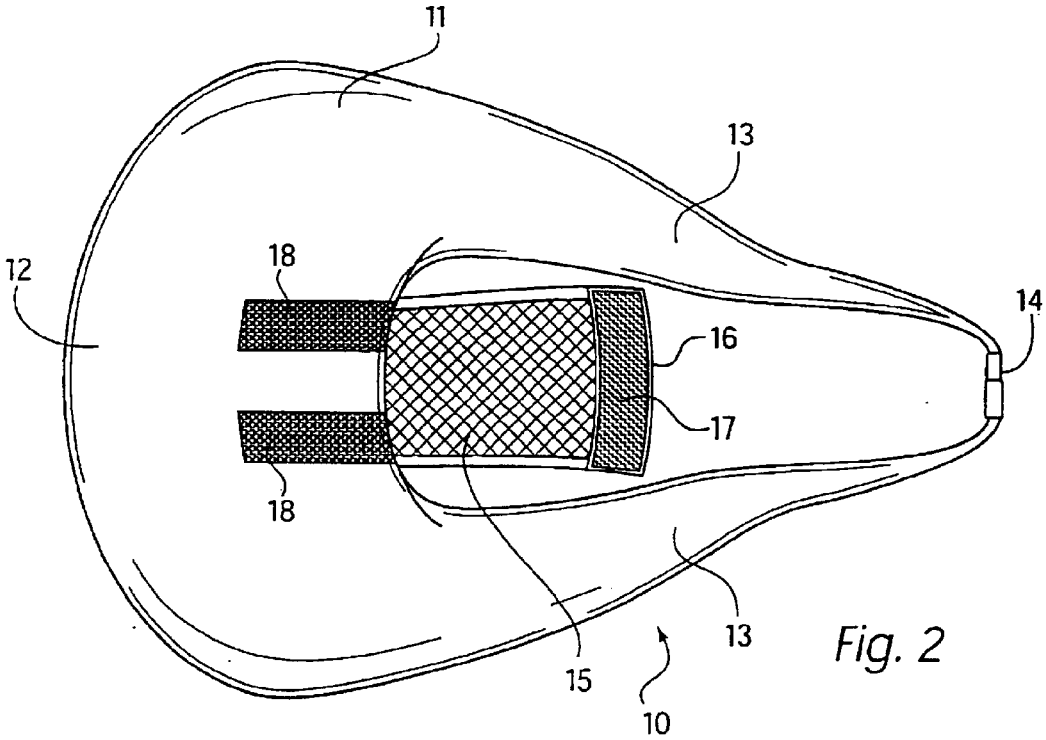
FIG. 2 shows a bottom view of the nursing pillow with the strap unattached.
Figure 3:
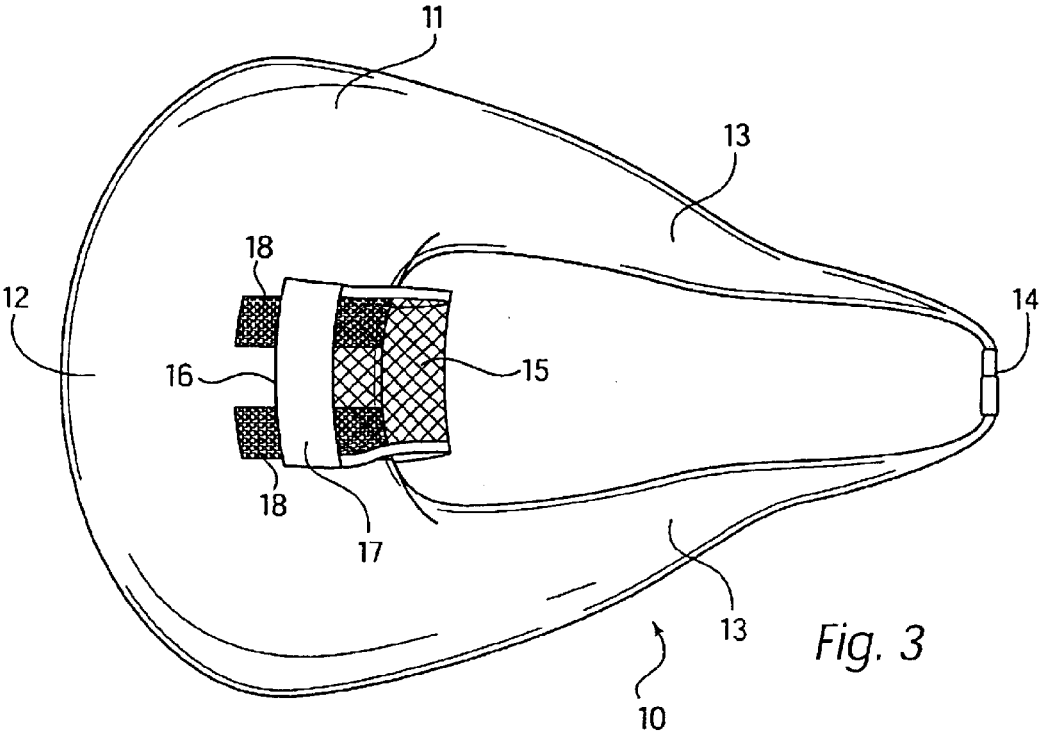
FIG. 3 shows a close-up view of the strap attaching mechanism of the nursing pillow.

Referring now in detail to the drawings and, in particular, FIGS. 1–4 show the nursing pillow 10 according to the invention. Pillow 10 comprises a U-shaped base 11 having a central area 12 and two arms 13. Base 11 is preferably made of a fabric shell filled with a soft filling. Arms 13 terminate in ends that are secured together by a buckle 14, for securing pillow 10 around a user's waist. Arms 13 have a smaller cross-section than central area 12 to allow arms 13 to deform to wrap around the user's waist.

A strap 15 is attached at one end to the bottom surface of central area 12, to wrap around and secure an infant 20 to base 11. Strap 15 is wide and made of a breathable mesh material. Strap 15 has a free end 16 that contains a strip 17 of hook and loop-type fastener. Base 11 comprises two strips 18 of hook and loop-type fastener that are disposed perpendicular to strip 17, so that strip 17 can be placed anywhere along strips 18 to secure strap 15 to base 11 in an adjustable manner.

Figure 4:
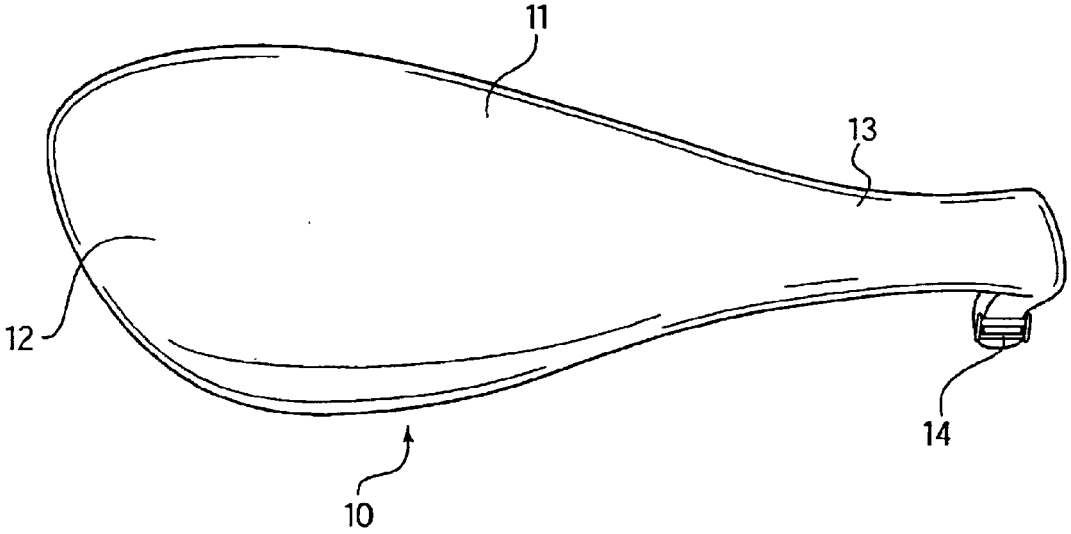
FIG. 4 shows a side view of the nursing pillow.

As shown in FIG. 4, base 11 has a slanted profile, so that an infant resting on the top surface of central portion 12 of base 11, is always facing toward the wearer, placing the infant in an optimal position for nursing.

Figure 5:
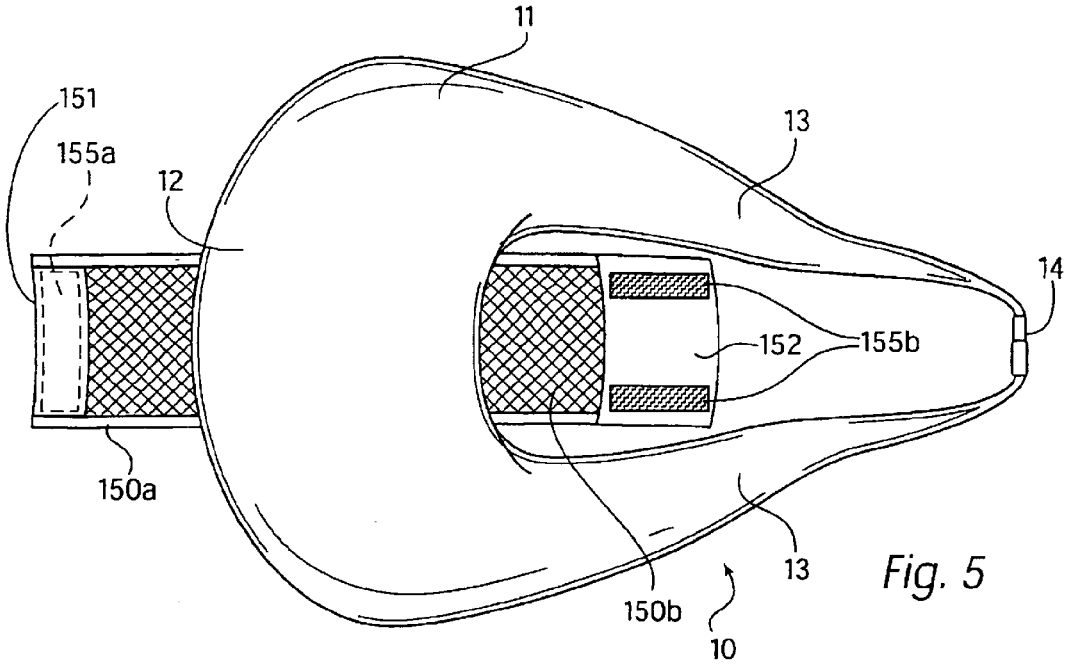
FIG. 5 shows a top view of an alternative embodiment of the nursing pillow according to the invention with the straps open.
Figure 6:
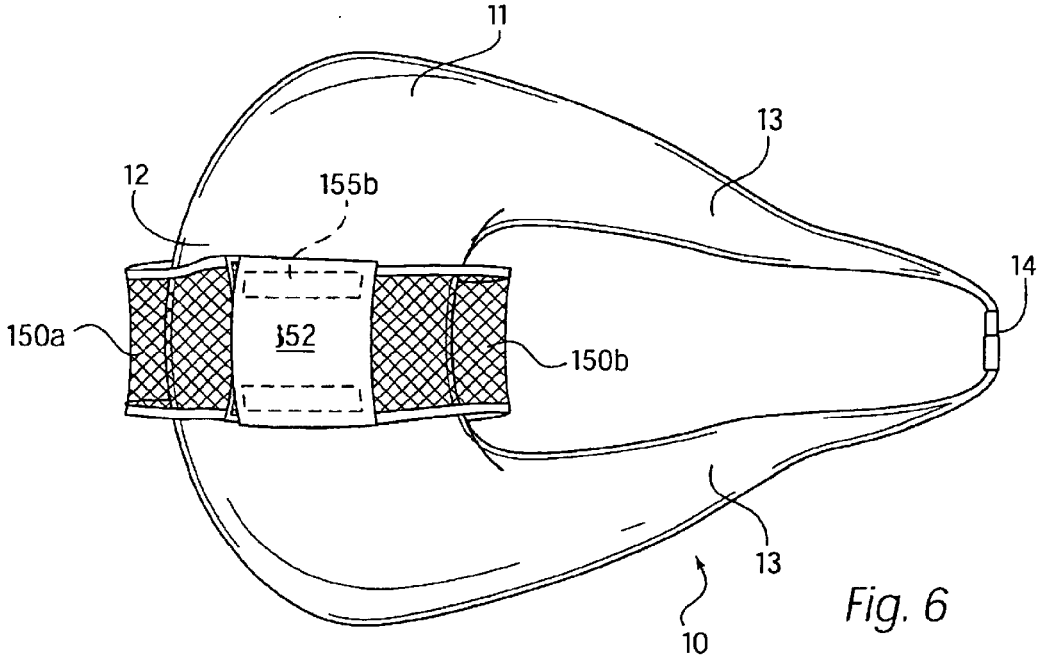
FIG. 6 shows a top view of the embodiment of FIG. 5 with the straps in a closed position.

FIG. 5 shows the pillow 10 according to the invention in an alternative embodiment, where instead of a single strap, there are two straps 150*a*, 150*b*. Straps 150*a*, 150*b* are connected to a bottom section of the base 11 and have free ends 151, 152 that are adapted to be connected to each other over an infants' body to secure the infant to the pillow 10. The straps 150*a*, 150*b* are preferably connected to each other via a hook-and-loop type fastener. In a most preferred embodiment, the straps are connected to each other in an adjustable manner, to accommodate infants of all sizes. For example, as shown in FIGS. 5 and 6, there could be a strip of fastener 155 across one free end 151, and two strips of fastener 155 disposed longitudinally along the other end 152, to allow for adjustable positioning of the straps 150. Other arrangements could also be used.

Accordingly, while only a few embodiments of the present invention has been shown and described, it is obvious that many changes and modifications may be made thereunto without departing from the spirit and scope of the invention.

What is claimed is:

1. A support pillow for supporting an infant during nursing, comprising:

a generally U-shaped base having two free ends, a top surface and a bottom surface; and two infant securing straps attached to said base and each strap having one free end, said straps being adapted to be wrapped over an infant resting on the top surface of said base with the free ends releasably connected to one another, to secure the infant on the base, wherein the straps are releasably connected to each other via a hook-and-loop type fastener that comprises a strip of fastener across the free end of one strap and two strips of fastener along the free end of the other strap, said two strips on said other strap being positioned perpendicular to the strip on said one strap, so that the straps can be attached to each other alone a defined area to accommodate infants of different sizes.

2. The support pillow according to claim 1, wherein the straps are made of a breathable mesh fabric.

3. The support pillow according to claim 1 wherein the two ends of the base are attachable to each other via a buckle.

4. The support pillow according to claim 1, wherein the top surface of the base is slanted so that when the pillow is worn around the waist of a person, an infant resting on said top surface is tilted toward that person.

5. The support pillow according to claim 1, wherein the base is made of a fabric shell filled with a soft filler.

6. The support pillow according to claim 1, wherein the base has a larger cross section in a central area than at its two ends.

* * * * *